United States Patent [19]

Belokin, Jr.

[11] Patent Number: 4,480,756

[45] Date of Patent: Nov. 6, 1984

[54] DISPLAY RACK FOR LIGHTWEIGHT MERCHANDISE

[76] Inventor: Paul Belokin, Jr., Route 4, Box D, Hayward, Wis. 54843

[21] Appl. No.: 469,259

[22] Filed: Feb. 24, 1983

[51] Int. Cl.[3] ..... A47F 5/11

[52] U.S. Cl. ..... 211/126; 108/111; 211/128; 211/133; 248/174

[58] Field of Search ..... 211/126, 128, 132, 130, 211/133, 194, 11; 108/91, 111; 248/174; 206/557

[56] References Cited

U.S. PATENT DOCUMENTS

| | | | |
|---|---|---|---|
| 1,893,755 | 1/1933 | Wentworth | 211/133 |
| 2,873,861 | 2/1959 | Jensen | 211/194 X |
| 3,144,134 | 8/1964 | Frommgen | 248/174 X |

FOREIGN PATENT DOCUMENTS

| | | | |
|---|---|---|---|
| 1215314 | 11/1959 | France | 211/133 |
| 566415 | 9/1957 | Italy | 211/133 |
| 672538 | 5/1952 | United Kingdom | 211/133 |

*Primary Examiner*—Robert W. Gibson, Jr.
*Attorney, Agent, or Firm*—James E. Nilles

[57] ABSTRACT

Each tray of a multiple tray display rack is formed from a single blank of kraftboard and has a single thickness bottom wall and a double-thickness side wall extending up from each edge of the bottom wall. An outer layer of each side wall is directly connected to the bottom wall around a bend line, and the inner layer is joined to the outer one around a fold line along the top edge of the side wall. The trays are supported in vertically spaced relation by four rods, each confined in one corner of each tray, inwardly adjacent to a flap that extends from an outer layer of one side wall at the corner and is bent around the corner to be sandwiched between the layers of the other side wall at the corner. Each rod is secured in its corner by the inner layers of the side walls that meet at the corner. Each inner layer has tabs projecting from its lower edge and received in closely fitting slots in the bottom wall whereby the inner layer is secured in flatwise proximity to its outer layer.

4 Claims, 9 Drawing Figures

DISPLAY RACK FOR LIGHTWEIGHT MERCHANDISE

FIELD OF THE INVENTION

This invention relates to point-of-sale display racks for lightweight merchandise such as packaged snack food, and the invention is more particularly concerned with an inexpensive display rack comprising a tray formed from a single piece of stiff but foldable material such as kraftboard, together with a plurality of rods that provide legs which support the tray.

BACKGROUND OF THE PRIOR ART

A rack of the general type to which this invention relates is intended to hold a relatively large quantity of fast-moving, lightweight merchandise, displaying it attractively so that it arrests the attention of potential customers and making it readily accessible so that a buyer can help himself. The display rack may be placed on a floor, or, in a smaller version, on a counter top. In either case, it is intended to stimulate impulse sales, and therefore the rack must be as compact as possible so that it can hold a fairly large stock of merchandise even though it occupies a minimum of space, both horizontally and vertically.

It is obviously important for a display rack of the type here under consideration to be very inexpensive, but equally important that it not look cheap. Desirably the rack should be available in unassembled form, in a very compact package of components that is capable of being handled and transported with a minimum of cost and inconvenience, but it should also be capable of being set up quickly and easily, even by unskilled persons and without the use of tools.

Although numerous display racks of various kinds and configurations have heretofore been devised, none of them has fully satisfied all of the requirements set forth above while at the same time providing the appearance of neatness, openness and accessibility that is a novel and important feature of the display rack of the present invention.

SUMMARY OF THE PRESENT INVENTION

The general object of this invention is to provide a display rack for point-of-sale display of lightweight merchandise that is very inexpensive but is nevertheless sturdy, holds a large quantity of merchandise while nevertheless occupying relatively little space, securely retains the merchandise while making it readily accessible to buyers, and presents a novel and arresting appearance which makes it effective as a silent salesman.

It is also an important object of the invention to provide a display rack of the character described that can be delivered to the user disassembled, in a flat, very compact package, and can be very quickly and easily set up without the use of tools and without the use of glue, cement or fastening devices of any kind.

Another and more specific object of the invention is to provide a display rack comprising two or more sturdy trays, each formed from a single piece of kraftboard or the like, together with a plurality of rod-like members that serve as legs upon which the trays are supported in vertically spaced relation to one another, and wherein the rod-like members are securely connected to each tray solely by virtue of the configuration of the blank that comprises the tray and the manner in which the blank is bent and folded to form the tray.

Another specific object of the invention is to provide a display rack of the character described that comprises a plurality of trays secured in a shelf-like arrangement by vertically extending supporting members which are very inexpensive and light in weight and which, although cooperating with the trays to provide a very rigid and sturdy structure, nevertheless permit merchandise on the trays to be seen from every direction.

It is also an important object of this invention to provide a floor-mounted display rack that achieves the objectives set forth above, having its lowest tray at a high enough level not to be struck by a wet mop when the floor is being cleaned, having supporting members that are not damaged by wetting, and having enough stability, sturdiness and rigidity to resist being upset by a mop or a broom striking against it.

In general, these and other objects of the invention that will appear as the description proceeds are achieved in the display rack of this invention, which is of the general type that comprises a tray formed from one piece of a stiff but foldable material such as kraftboard, having a bottom wall with straight side edges and having a side wall projecting up from the bottom wall all along each of said side edges, and supporting means for said tray whereby it is held with its bottom wall elevated. The display rack of this invention is characterized by said supporting means comprising a plurality of upright rods, one for each of the corners defined by the junctions of lengthwise adjacent side walls of the tray and by the tray having each of its side walls formed with two flatwise superimposed layers of material, an outer one of said layers being connected to the bottom wall around a bend line along one of said side edges, and the inner one of said layers being connected to the outer layer around a fold line along the top edge of the side wall. Further, the tray has at each of said corners a flap which extends from the outer layer of one of the pair of side walls at the corner and which is bent around the corner and is flatwise confined between the layers of the other side wall of the pair. The rod at each of said corners is confined against laterial displacement relative to the tray by being received in the bend of the flap at the corner and being confined in said bend by an inner layer of each of the two side walls that meet at the corner. Each rod has an upwardly facing abutment which is spaced above its bottom end and by which the tray is supportingly engaged.

In one embodiment of the invention the abutment on each rod is defined by a jog in the rod whereby one portion of the rod is disposed in laterally offset relationship to another and lengthwise adjacent portion thereof. In another embodiment, the abutment on each rod is defined by a laterally extending strut whereby the rod is connected in spaced, parallel relation to another of said rods.

Preferably the inner layer of each side wall has at least one tab projecting downwardly from its bottom edge and received in a closely fitting slot in the bottom wall whereby said inner layer is confined in flatwise contiguous relationship to the outer layer.

BRIEF DESCRIPTION OF DRAWINGS

In the accompanying drawings, which illustrate what are now regarded as preferred embodiments of the invention.

DETAILED DESCRIPTION OF PREFERRED EMBODIMENTS OF THE INVENTION

An assembled display rack of this invention comprises, in general, a plurality of trays 5, each formed from a single blank of a stiff but foldable material such as kraftboard or thick cardboard, and a plurality of upright rods 6 which support the trays 5 in vertically spaced relationship, one over the other.

Figure 3:
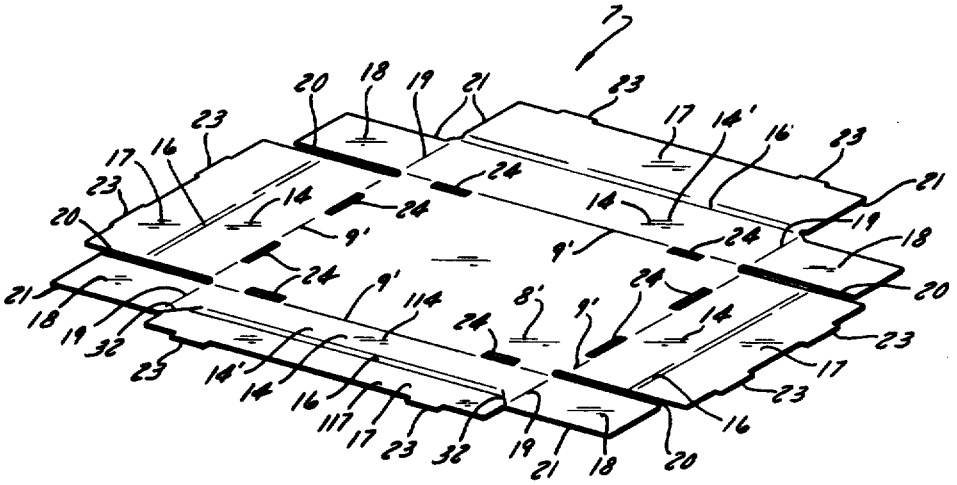
FIG. 3 is a perspective view of a blank that can be formed up into one of the trays in a rack of this invention.
Figure 4:
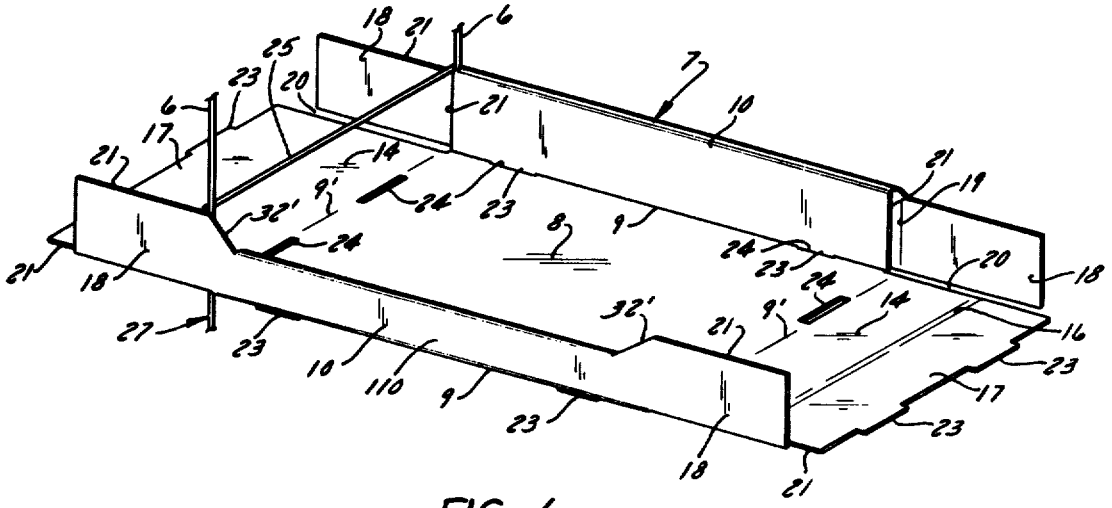
FIG. 4 is a perspective view of a tray blank that has been partially formed up, in its relation to a leg unit comprising one pair of legs.

The one-piece blank 7 from which each tray 5 is formed is shown in FIG. 3 and is described in detail hereinafter. In general, that blank 7 is so configured and scored that the tray 5 into which it is bent and folded has a single-thickness bottom wall 8 with straight side edges 9 and has a horizontally elongated double-thickness side wall 10 projecting up from each of the side edges 9. Depending upon the planform of its bottom wall 8, each tray 5 could be triangular, polygonal, trapezoidal or the like, but in its preferred form here shown each tray is rectangular (or square) to have a bottom wall 8 with four straight side edges 9 and with four side walls 10 that project up from the respective edges of the bottom wall and meet one another at right-angle corners 11. In this case, therefore, the trays 5 are supported by four upright rods 6, each secured in a corner 11 of each tray as described hereinafter.

Figure 2:
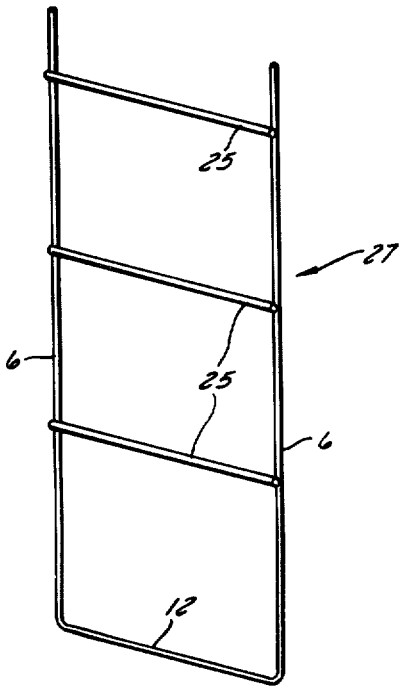
FIG. 2 is a perspective view of a leg unit comprising a pair of rods and the transverse struts connecting them.
Figure 8:
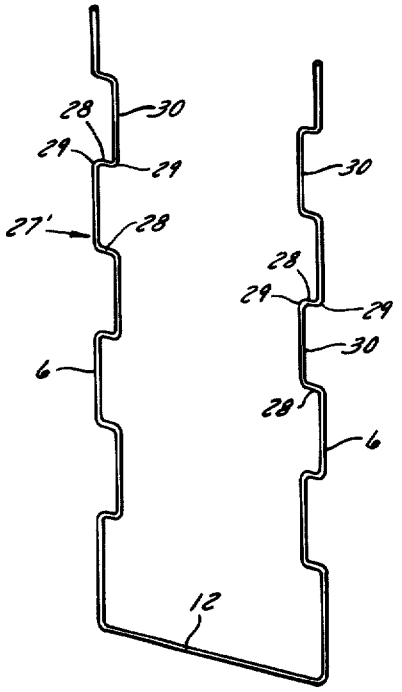
FIG. 8 is a perspective view, generally corresponding to FIG. 2 but illustrating a modified form of the unit comprising a pair of rods.

As shown in FIGS. 2 and 8, the two rods 6 at each end of the rack preferably comprise the oppposite sides of a U-shaped unit, being bent up from an integral straight bight portion 12 that connects them and comprises the base of the rack.

Figure 5:
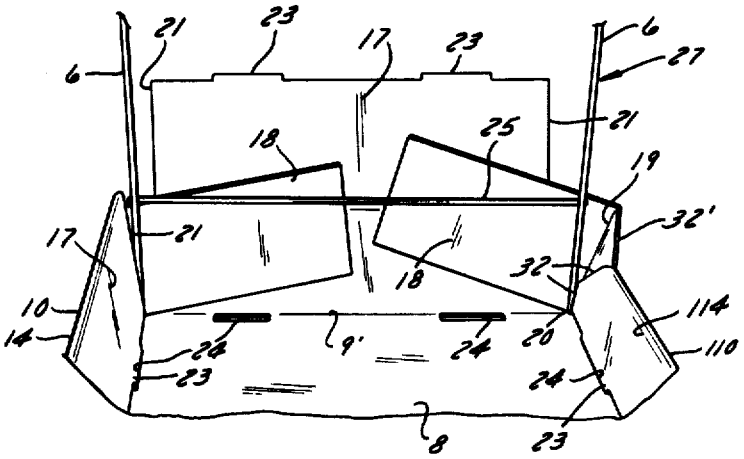
FIG. 5 is a detail perspective view of a blank in the process of being formed up and assembled to a pair of legs.
Figure 9:
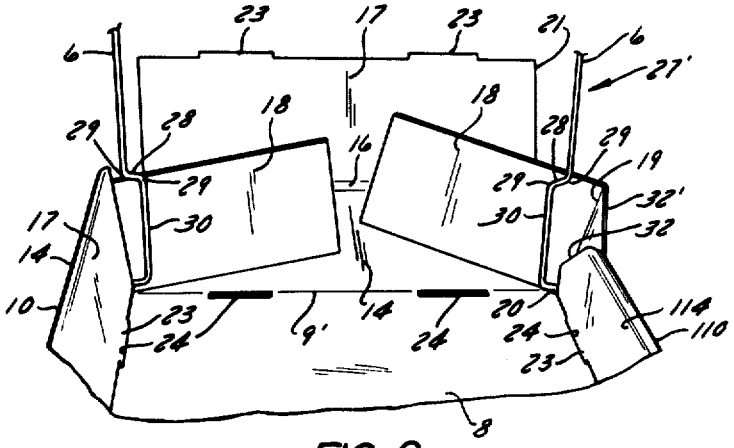
FIG. 9 is a detail perspective view generally similar to FIG. 5, but illustrating assembly of a tray with the modified form of leg unit shown in FIG. 8.

The blank 7 for each tray 5 has a central panel 8' which provides the bottom wall 8 of the tray and which is defined by straight score lines 9' that coincide with the side edges 9 of the bottom wall. Outwardly adjacent to the central panel 8', defined from it by the respective score lines 9', are four elongated proximal wall panels 14, each of which serves as an outer layer of one of the double-thickness side walls 10 of the tray 5. Outwardly adjacent to each proximal wall panel 14 and defined from it by a score line 16 is a distal panel 17 which is to form an inner layer of the side wall 10 that comprises the adjacent proximal panel 14. Outwardly adjacent to each corner of the central panel 8' is a flap 18 of substantial length which projects endwise from one of the proximal panels 14 and which is defined from that proximal panel by a score line 19 that aligns with a score line 9'. In the formed-up tray, each flap 18 is bent on its score line 19 to extend around the corner from the proximal panel 14 to which it is attached (as best seen in FIGS. 5 and 9) and is flatwise received between the two layers of the adjacent double-thickness wall. As here shown, the flaps 18 project from opposite ends of the two proximal panels 14' that extend along the two longer sides of the tray.

When a tray 5 is formed up from a blank 7, each of the flaps 18 of the blank is bent up substantially at right angles to its proximal panel 14', along its score line 19; and each proximal panel 14, 14' is then bent up along its score line 9' to be at right angles to the central panel 8', thereby bringing the flaps 18 into flatwise inwardly overlying relation to the shorter proximal panels 14, as shown in FIGS. 8 and 9. Each of the distal panels 17 is then folded downwardly and inwardly, to be flatwise contiguous to the proximal panel 14 to which it is connected and to form an inner layer of the two-thickness side wall that it comprises with its distal panel. A score line 16 thus extends along the upper edge of each double thickness side wall 10 in the formed-up tray.

Figure 6:
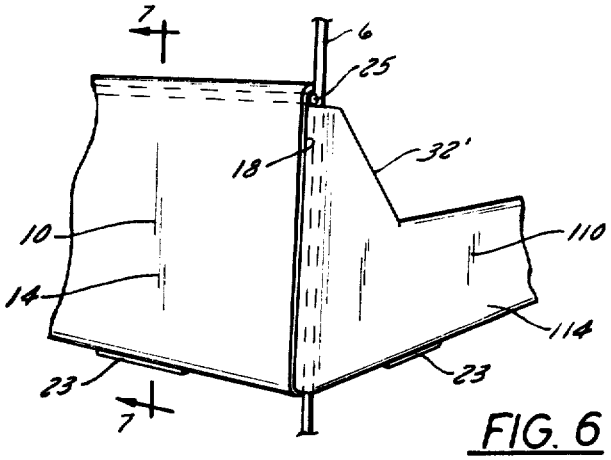
FIG. 6 is a detail perspective view taken at a corner of a tray that has been completely formed up and assembled with its legs.

Each of the elongated flaps 18 is separated by a slot 20 from the wall panels 14, 17 that are laterally adjacent to it and between which it is to be sandwiched. The width of each slot 20 is substantially equal to the diameter of one of the rods 6, and the slot is long enough to extend into the proximal panel 14' to which its bounding flap 18 is attached, to a depth substantially equal to the width of a rod 6. As best seen in FIGS. 5, 6 and 9, each of the rods 6 extends up through the inner end portion of a slot 20 and lies along the score line 19, in the corner defined by the flap 18 and the proximal panel 14' from which that flap projects, so that the rod is held by the bend in the flap against lateral displacement in the directions outwardly of the two side walls 10 which meet at the corner 11 where the rod is confined.

Each rod is retained in its corner 11 of the tray by its adjacent inwardly and downwardly folded distal wall panels 17, which provide the inner layers of the two double-thickness walls 10 that meet at that corner. More specifically, each of the distal panels 17 has, at each of its ends, an edge 21 which (in the unfolded blank) is substantially aligned with score lines 9' and 19 and which extends vertically in the formed up tray; and along each such end edge 21 the distal panel is engaged against the rod 6 in its corner. Each rod is thus firmly confined against lateral displacement by a flap 18, the proximal panel 14' from which that flap projects, and end edge portions of a pair of distal panels 17, all of which cooperate to substantially enclose or cover the portion of the rod that extends through the tray.

To maintain each of the upright edge portions of each distal panel 17 securely engaged with the rod 6 that it confines, the distal panel 17 must be securely maintained in flat-wise proximity to its contiguous proximal panel 14. To that end, the outer longitudinal edge of each distal panel 17 has a pair of outwardly projecting tongues or tabs 23, one near each end of that panel, and those tongues are receivable in closely fitting slots 24 in the central panel 8' that are inwardly contiguous to the score lines 9'.

Figure 7:
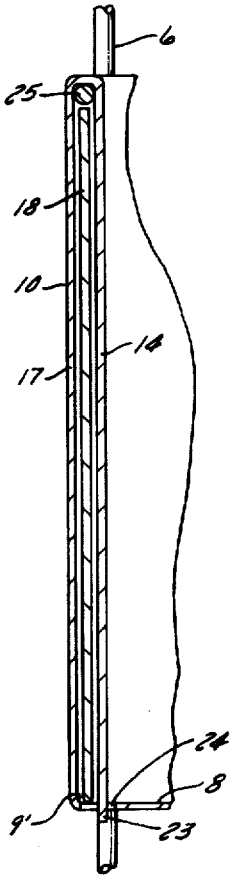
FIG. 7 is a view in vertical section, taken on the plane of the line 7—7 in FIG. 6.

To prevent the trays 5 of the assembled rack from sliding down along the rods 6, each rod has an upwardly facing abutment 25 for each of the trays of the rack, whereby the tray is supported. In the embodiment of the invention that is illustrated in FIGS. 2, 4, 5 and 6, each abutment 25 comprises a horizontally extending strut, preferably made of the same stock as the rods 6 themselves, and each of the several struts 25 is connected to the two rods that comprise a leg unit, so that the several connected rods and struts comprise a ladder-like unit 27. The struts 25 can be secured to the rods by spot weldments. The assembled rack comprises two such ladder-like units 27, one at each of the narrower ends of the trays, and each strut 25 underlies the fold between the proximal and distal panels which comprise that wall, as best seen in FIG. 7. To accommodate the thickness of a strut 25, each of the score lines 16 can be a double score, with two close parallel lines.

In the less expensive embodiment of the invention illustrated in FIGS. 8 and 9, the rods of the leg unit 27' are connected only by the integral bight portion 12 at their bottom ends, and the abutments that provide vertical support for the trays comprise jogs or short laterally extending portions 28 of each rod, each defined by a pair of opposite right angle bends 29 in the rod. The jogs 28 are arranged in pairs, and between each pair of jogs is a segment 30 of the rod which is laterally inwardly offset relative to the rest of the rod and which has a length equal to the height of the side walls 10 of a tray. As is apparent from FIG. 9, each such offset segment 30 is confined in the corner of a tray as described above, and the jogs 28 that define the segment engage the upper and lower edges of the flap 18 at that corner to provide the abutments which prevent displacement of the tray in either direction along the rod.

Although the less expensive leg unit 27' of FIG. 8 provides less support and reinforcement for the trays than the ladder-like unit of FIG. 2, it has been found to provide a rack that is adequately sturdy and rigid for most purposes. Either of these leg units could be modified in an obvious manner to cooperate with trays of different sizes, arranged in progressively decreasing width and/or length towards the top of the rack and in either a stepped back or a pyramidal relationship.

Figure 1:
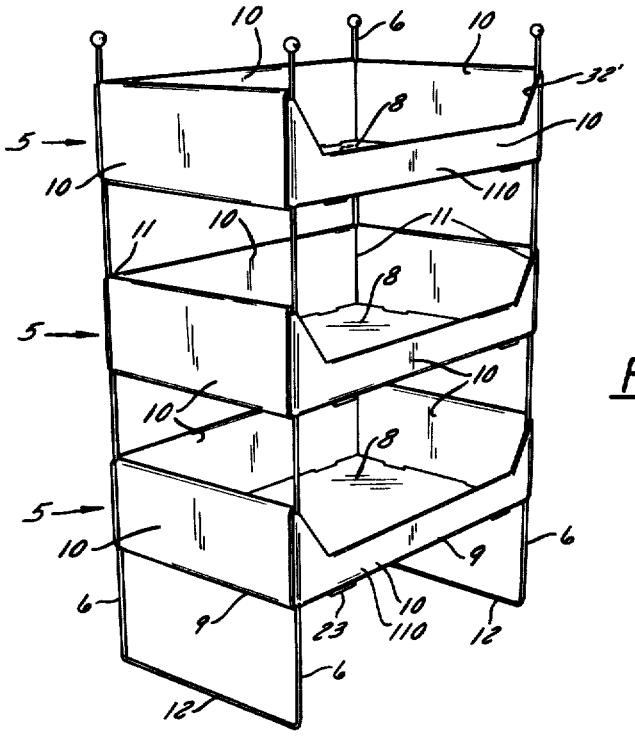
FIG. 1 is a perspective view of an assembled display rack that constitutes one of the preferred embodiments of the invention.

In preferred embodiments of the invention, one of the longer side walls of each tray (as designated by 110 in FIGS. 1 and 6) has a lower height, along most of its length, than the other three side walls, to facilitate loading and unloading of the tray. The proximal panel 14' and the distal panel 17 of that lower-height wall are in the main equal to one another in width but are narrower than the corresponding panels of the other three side walls. These narrower panels are respectively designated by 114 and 117 in FIG. 3. However, to provide full-height corner portions of that one side wall, for adequate confinement of the rods at its ends, the score line 16 between the panels 114 and 117 terminates some distance short of each end of those panels, and from each end of that score line a slit 32 extends obliquely out to the adjacent end edge 21, to near the junction of that end edge with the adjacent flap 18. When the distal panel 117 is bent downwardly and inwardly to its formed-up position, the slits 32 define obliquely extending top edge portions 32' at the ends of the lower-height side wall, as best seen in FIG. 6.

From the foregoing description taken with the accompanying drawings it will be apparent that this invention provides a very inexpensive but sturdy and attractive merchandise display rack, capable of being shipped and handled in knocked down form as a very compact substantially flat package and capable of being quickly and easily set up, without the use of tools or fasteners, by a series of practically self-explanatory bending and folding operations.

What is claimed as the invention is:

1. A display rack comprising a tray formed of one piece of a stiff but foldable material such as kraftboard, having a bottom wall with straight side edges and having a plurality of upright side walls that project up from said side edges and meet one another at corners, and supporting means whereby said tray is held with its bottom wall elevated, said display rack being characterized by:

A. said supporting means comprising a plurality of upright rods, one for each of said corners;

B. said tray having each of its side walls formed with two flatwise superimposed layers of material, (1) an outer one of said layers being connected to said bottom wall around a bend line along one of said side edges and (2) the inner one of said layers being connected to the outer layer around a fold line along the top edge of the side wall;

C. said tray further having, at each of said corners, a flap which extends from the outer layer of one of the pair of side walls at the corner and which is bent around the corner and is flatwise confined between the layers of the other side wall of the pair;

D. the rod at each of said corners being confined against lateral displacement relative to the tray by (1) being received in the bend of the flap at the corner, and (2) being retained in said bend by the inner layers of the pair of side walls that meet at the corner, each of which inner layers has a portion extending along an upright end edge thereof that engages the rod; and E. each rod having an upwardly facing abutment which is spaced above its bottom end and which supportingly engages the tray.

2. The display rack of claim 1, further characterized by:

F. the inner layer of each side wall having at least one tab projecting downwardly from its bottom edge and received in a closely fitting slot in the bottom wall whereby said inner layer is confined in flatwise contiguous relationship to the outer layer and each of the end edge portions of the inner layer is maintained engaged with a rod.

3. The display rack of claim 1 wherein said abutment on each rod is defined by a laterally extending strut which connects the rod in spaced, parallel relation to another rod and which extends along and beneath the fold line between the inner and outer layers of a side wall.

4. The display rack of claim 1 wherein said abutment on each rod comprises a short, laterally extending portion of the rod that is between and defined by a pair of opposite right angle bends in the rod.

* * * * *